US009330638B2

(12) United States Patent
Maslarov

(10) Patent No.: US 9,330,638 B2
(45) Date of Patent: May 3, 2016

(54) TREMOLO DEVICE FOR A STRINGED MUSICAL INSTRUMENT

(71) Applicant: Teodor Dimitrov Maslarov, Sofia (BG)

(72) Inventor: Teodor Dimitrov Maslarov, Sofia (BG)

( * ) Notice: Subject to any disclaimer, the term of this patent is extended or adjusted under 35 U.S.C. 154(b) by 0 days.

(21) Appl. No.: 14/437,296

(22) PCT Filed: Jan. 7, 2014

(86) PCT No.: PCT/BG2014/000001
§ 371 (c)(1),
(2) Date: Apr. 21, 2015

(87) PCT Pub. No.: WO2015/000041
PCT Pub. Date: Jan. 8, 2015

(65) Prior Publication Data

US 2015/0279341 A1 Oct. 1, 2015

(30) Foreign Application Priority Data

Dec. 4, 2013 (BG) ..... 111644

(51) Int. Cl.
*G10D 3/14* (2006.01)

(52) U.S. Cl.
CPC ..... *G10D 3/146* (2013.01)

(58) Field of Classification Search
CPC ..... G10D 3/146
See application file for complete search history.

(56) References Cited

U.S. PATENT DOCUMENTS 4,768,415 A * 9/1988 Gressett, Jr. ..... G10D 3/146 84/267
5,481,955 A * 1/1996 Goto ..... G10D 3/146 84/313
6,084,166 A * 7/2000 Lee ..... G10D 3/146 84/267
6,686,524 B2 * 2/2004 Hirayama ..... G10D 3/146 84/291
6,867,354 B2 * 3/2005 Shimooka ..... G10D 3/146 84/298
7,009,096 B2 * 3/2006 Hirayama ..... G10D 3/146 84/312 R
7,235,730 B2 * 6/2007 Hirayama ..... G10D 3/146 84/307
7,470,841 B1 * 12/2008 McCabe ..... G10D 3/146 84/312 R
7,479,592 B1 * 1/2009 Slavik ..... G10D 3/146 84/312 R
7,888,571 B2 * 2/2011 Steinberger ..... G10D 3/146 84/267
8,865,985 B2 * 10/2014 Maslarov ..... G10D 3/146 84/313
2004/0177741 A1 9/2004 Hirayama
2005/0160897 A1 7/2005 Hirayama

FOREIGN PATENT DOCUMENTS

EP 0 500 995 A1 9/1992
WO 2012/162764 A1 12/2012

OTHER PUBLICATIONS

International Search Report, dated Jul. 15, 2014, from corresponding PCT application.

* cited by examiner

*Primary Examiner* — Robert W Horn
(74) *Attorney, Agent, or Firm* — Young & Thompson

(57) ABSTRACT

The tremolo device can be used in stringed musical instruments, and more particularly in electric guitars. It provides a simplified construction allowing easier usage and improved sustain, wherein, in the front portion of the rear string saddle (5) an opening (5*f*) is formed, which axis is nonparallel to and does not intersect the saddle assembly shaft (7) axis and also does not intersect the string (29) axis. In the opening (5*f*) the fine tuning spring (6) is disposed, reaching the opening bottom with one end and with the other—the back wall of the front string saddle (4).

1 Claim, 6 Drawing Sheets

TREMOLO DEVICE FOR A STRINGED MUSICAL INSTRUMENT

TECHNICAL FIELD

The present invention relates to a tremolo device for a stringed musical instrument and more particularly to an electric guitar. The electric guitar equipped with tremolo device and double locking allows smooth pitch increase and decrease of the tone without that resulting later in strings coming out of tune. The present tremolo device can be used also on electric guitars adapted for a non-locking tremolo device.

BACKGROUND ART

A known tremolo device for stringed musical instrument [1] comprises a base plate, on the upper surface of which saddle assemblies are independently mounted corresponding to the number of the strings, each assembly including a front and a rear string saddle. The saddles have asymmetrically projecting arms movably connected to each other via a saddle assembly shaft, located perpendicularly to the corresponding string. To each saddle assembly means are provided for their fixing on the base plate, for fine tuning, intonation adjustment and string locking. In the front string saddle a slot is formed housing a saddle mounting screw mounted in a threaded opening in the base plate, and at the back portion of the rear string saddle a rear slot is formed, housing a fine tuning screw mounted in a threaded opening in the base plate. In the front portion of the rear string saddle a string receiving recess is formed extending to the front slot, which axis is parallel to the axis of the slot in the front string saddle and to the axis of the rear slot. In the front slot a string lock insert is mounted. From the front slot to the back wall of the rear string saddle a lower threaded opening is extended in which a string lock screw is mounted and which is screwed up to the front slot and to the string lock insert mounted in it. From the rear slot to the back wall of the rear string saddle an upper threaded opening is formed, in which an adjustment screw is disposed contacting with the fine tuning screw head. The axes of the slot in the front string saddle and the rear slot in the rear string saddle are parallel and displaced with respect to the axis of the corresponding string. The string lock insert is formed by a head and a cylindrical body. In the lower portion of the string lock insert a slot is formed reaching the rear part of the string lock screw. The string lock insert is mounted so that the slot is at the height of the string lock screw. The base plate abuts against a pivot assembly, each one including a pivot stud and a pivot insert. To the base plate front end circular recesses are provided, conically beveled at the upper and lower surface of the base plate so that with each circular slot a knife edge is formed engaged with a double conical recess below the head of each pivot stud. To the lower surface of the base plate a sustain block is mounted by means of block mounting screws. In one side of the sustain block an opening with arm bush is formed in which a tremolo arm is mounted. It is fixed by a screw and passes through an opening in the base plate. To the lower side of the sustain block a balancing mechanism is mounted, inserted in a cavity provided on the lower side of the instrument body, including a number of springs which ends are fixed to the spring claw, the other ends are immovably fixed to the sustain block by means of hooks and spring fix screws. The adjustment screw is mounted in the upper threaded opening of the rear string saddle contacting the fine tuning spring which axis is perpendicular to the axis of the saddle assembly shaft, the axes being at some distance from each other. The fine tuning spring is disposed in a recess provided in the sustain block upper side and passes through an opening in the base plate reaching the lower surface of the corresponding rear string saddle, the spring axis being perpendicular to and intersecting the string axis.

A disadvantage of the known tremolo device for stringed musical instrument is its complicated construction and difficult usage at unsatisfactory sustain.

SUMMARY OF THE INVENTION

The object of the present invention is to provide a tremolo device for a stringed musical instrument with simplified construction allowing easier usage and improved sustain.

This object is accomplished by a tremolo device for a stringed musical instrument comprising a base plate, on the upper surface of which are independently mounted saddle assemblies corresponding to the number of the strings, each assembly including a front and a rear string saddle with asymmetrically projecting arms movably connected to each other via a saddle assembly shaft located perpendicularly to the corresponding string. To each saddle assembly means are provided for their fixing on the base plate, for fine tuning, intonation adjustment and string locking. In the front string saddle a slot is formed housing a saddle mounting screw mounted in a threaded opening in the base plate. In the back portion of the rear string saddle a rear slot is formed housing a fine tuning screw mounted in a threaded opening in the base plate. In the front portion of the rear string saddle a string receiving recess is formed extending to the front slot, which axis is parallel to the axis of the slot in the front string saddle and to the axis of the rear slot. In the front slot a string lock insert is mounted. From the front slot to the back wall of the rear string saddle a lower threaded opening is extended, in which a string lock screw is mounted and screwed up to the front slot and to the string lock insert mounted in it. From the rear slot to the back wall of the rear string saddle an upper threaded opening is formed, in which an adjustment screw is disposed, contacting with the fine tuning screw head. The axes of the slot in the front string saddle and the rear slot in the rear string saddle are parallel and displaced with respect to the axis of the corresponding string. The string lock insert is formed by a cylindrical body wherein in the lower portion of the string lock insert a slot is formed reaching the rear part of the string lock screw. The string lock insert is mounted so that the slot is at the height of the string lock screw. The base plate abuts against a pivot assembly, each one including a pivot stud and a pivot insert. To the base plate front end circular recesses are provided, conically beveled at the upper and lower surface of the base plate so that with each circular slot a knife edge is formed engaged with a double conical recess below the head of each pivot stud. To the lower surface of the base plate a sustain block is mounted by means of block mounting screws. In one side of the sustain block a two step opening with an arm bush is formed, through which a tremolo arm passes. To the lower side of the sustain block a balancing mechanism is mounted, inserted in a cavity provided on the lower side of the instrument body, including a number of springs which ends are fixed to the spring claw, the other ends are immovably fixed to the sustain block by means of hooks and spring fix screws. The adjustment screw is mounted in the upper threaded opening of the rear string saddle. The rear string saddle reaches the fine tuning spring which axis is perpendicular to the axis of the saddle assembly shaft and the axes are at some distance from each other. The tremolo device according to the present invention wherein in the front portion of the rear string saddle an opening is formed, which axis is nonparallel to and does not intersect the saddle assembly shaft axis and also the string axis. In the opening the fine tuning spring is disposed reaching the opening bottom with one end and with the other—the back wall of the front string saddle.

An advantage of the tremolo device for a stringed musical instrument according to the present invention is its simplified construction allowing easier usage and improved sustain.

DESCRIPTION OF THE DRAWINGS

The tremolo device for a stringed musical instrument according to the invention is clarified by the following brief description of the presently preferred embodiment, illustrated by the attached figures, wherein.

DESCRIPTION OF THE PREFERRED EMBODIMENT

Figure 1:
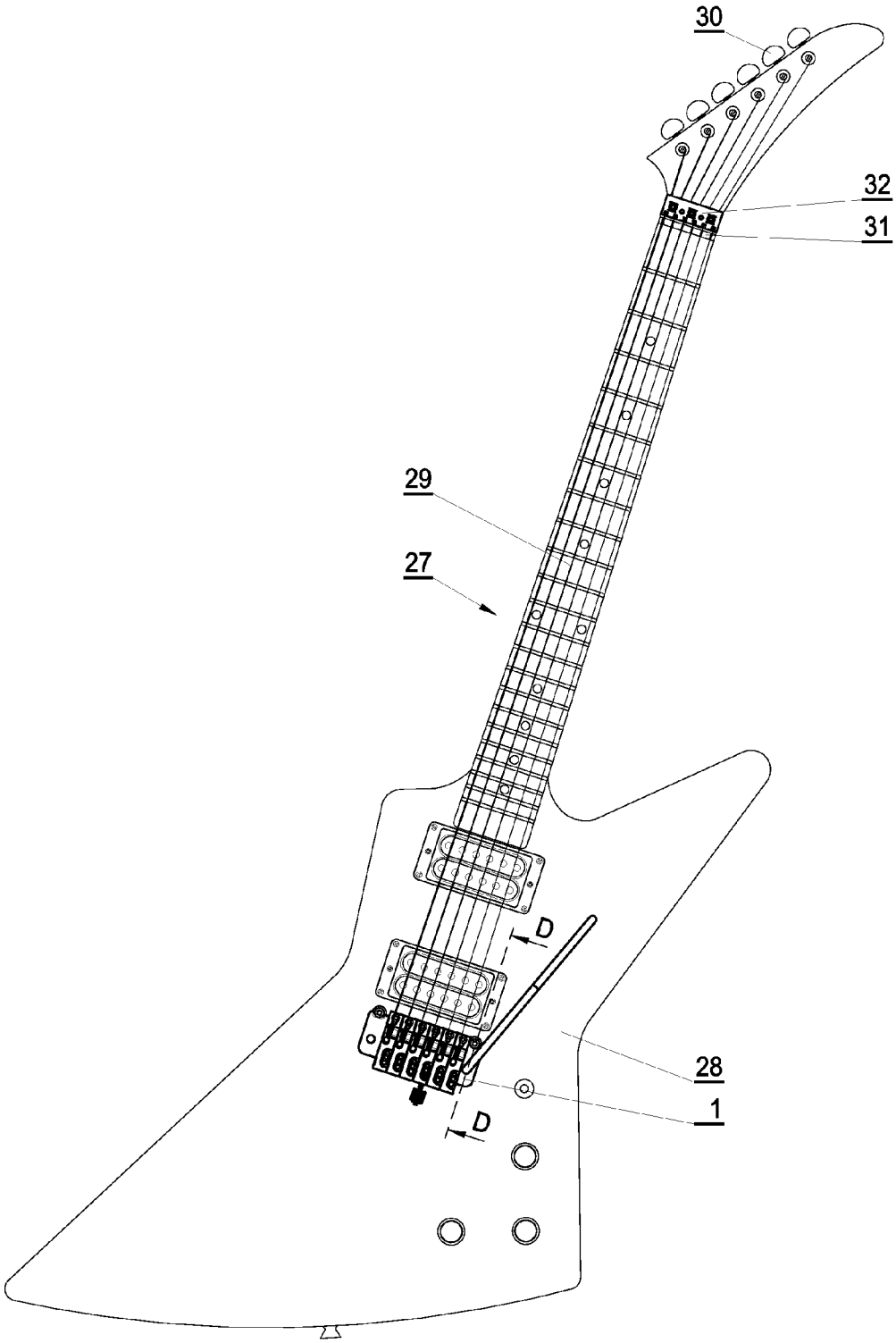
FIG. 1 is a top view of an electric guitar, equipped with a tremolo device and a top lock unit.
Figure 2:
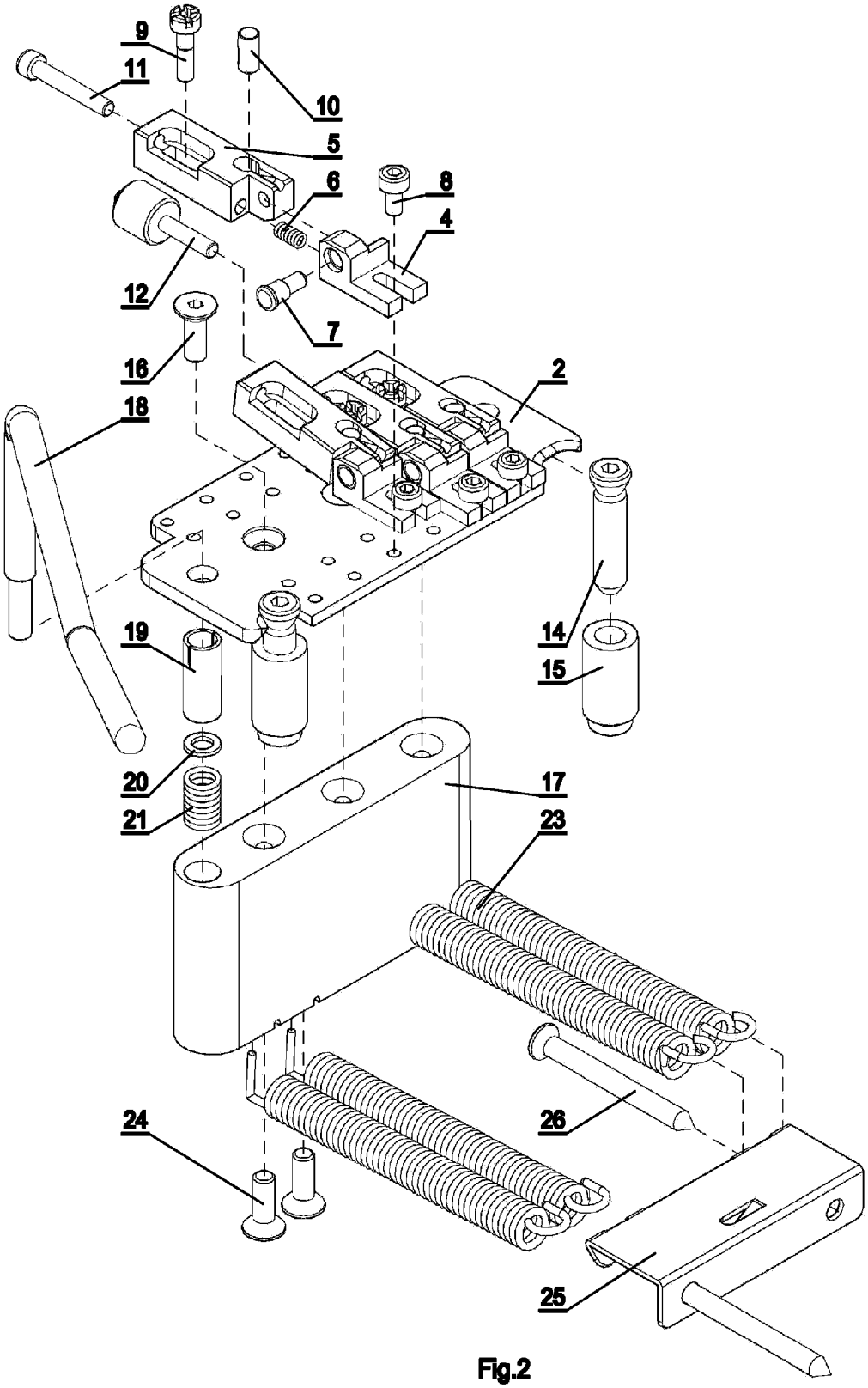
FIG. 2 is an exploded perspective view of the tremolo device.
Figure 3:
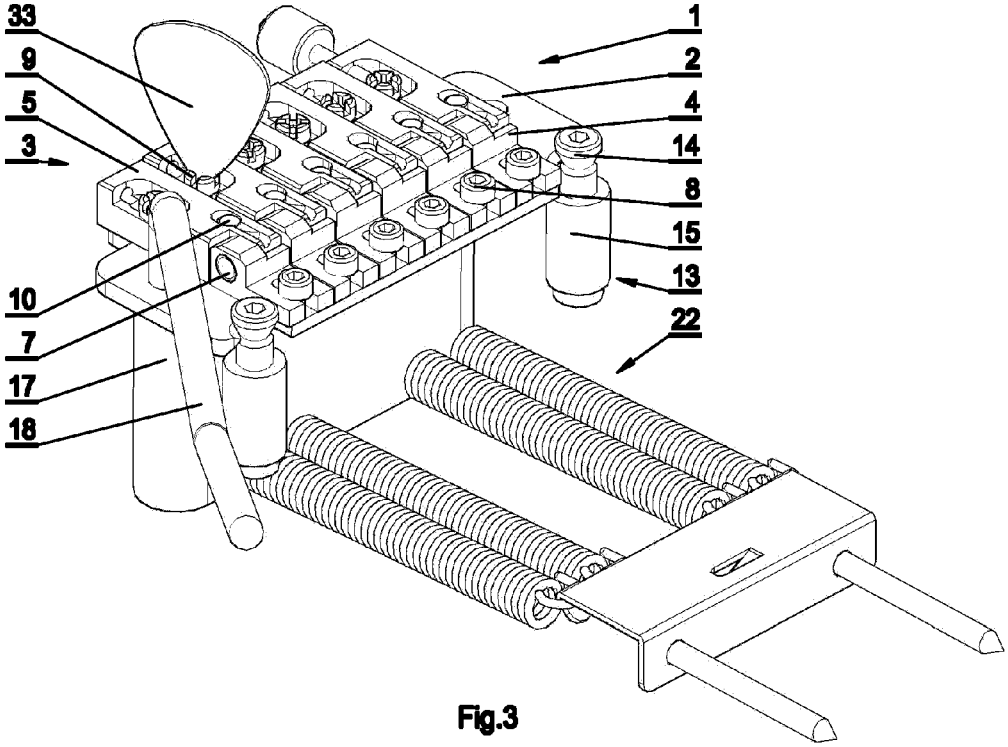
FIG. 3 is a perspective view.
Figure 4:
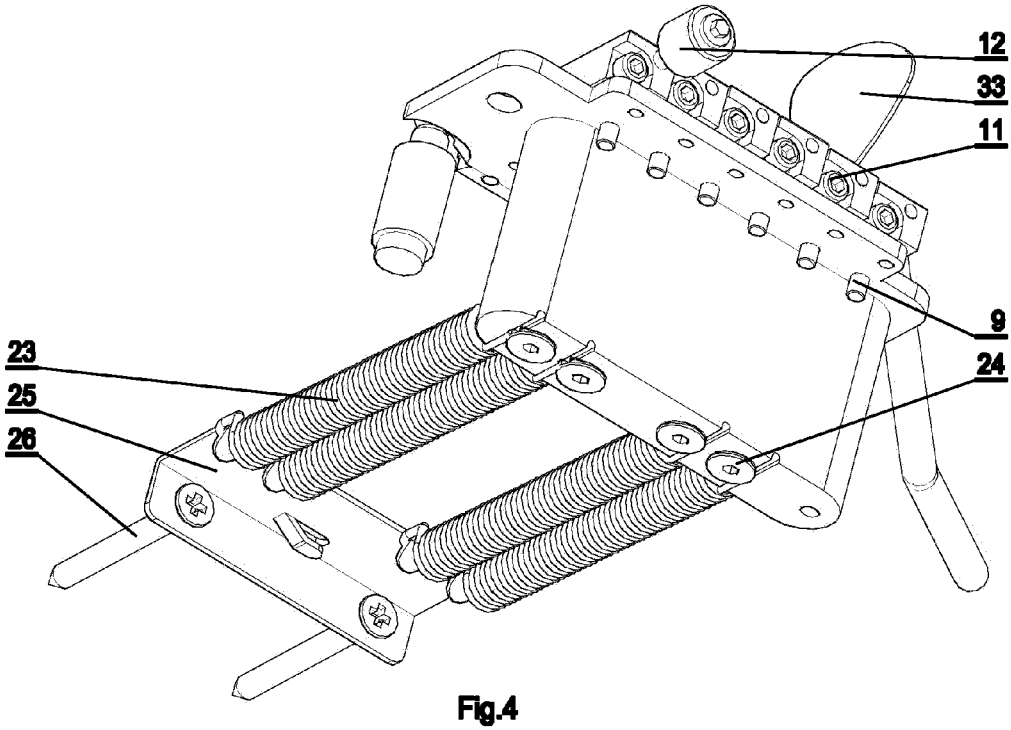
FIG. 4 is a perspective view from the lower side of the device.
Figure 5:
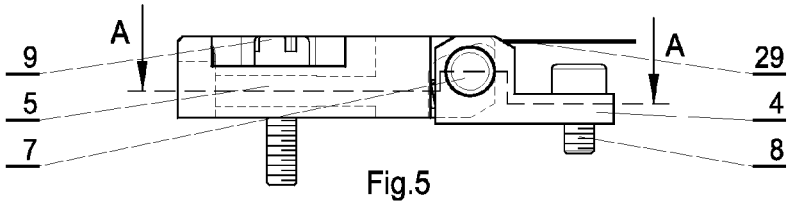
FIG. 5 is a side view of the saddle assembly.
Figure 6:
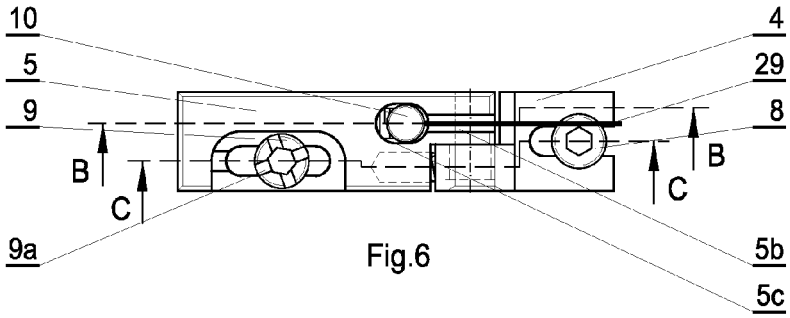
FIG. 6 is a top view of the saddle assembly.
Figure 7:
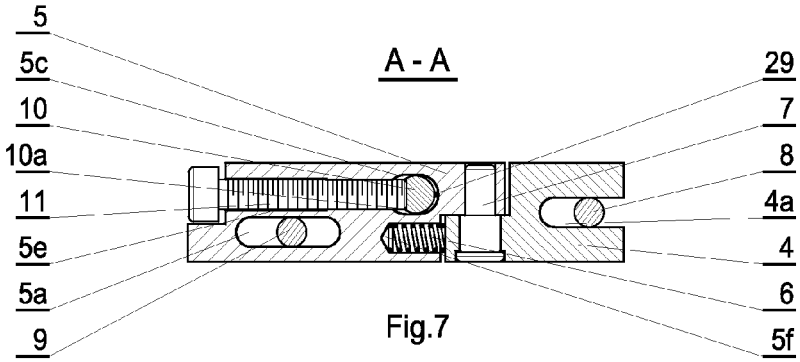
FIG. 7 is a partial sectional view taken along line A-A of FIG. 5.
Figure 8:
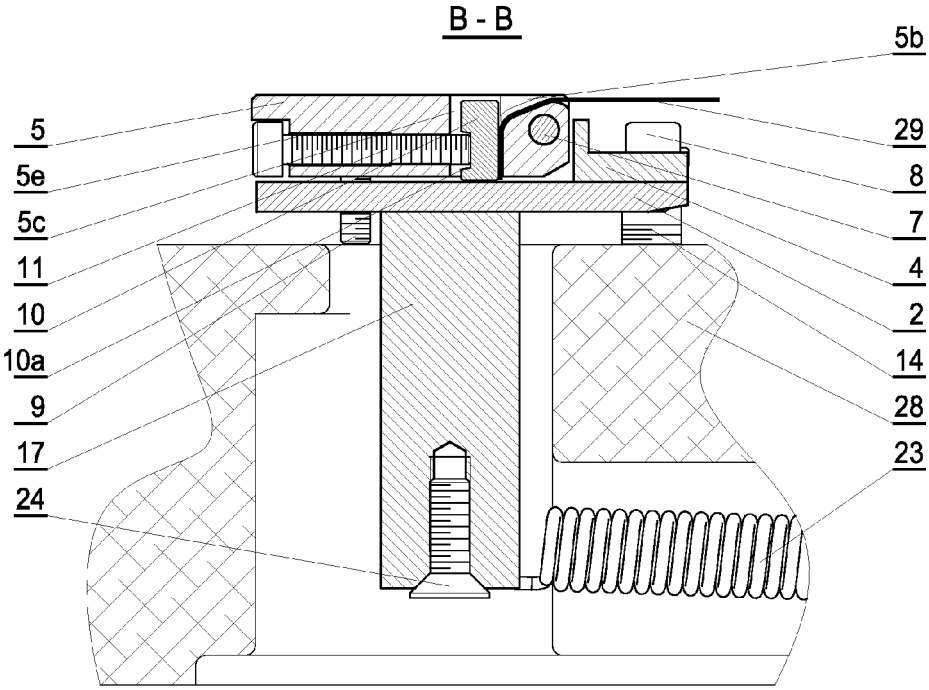
FIG. 8 is a partial sectional view taken along line B-B of FIG. 6.
Figure 9:
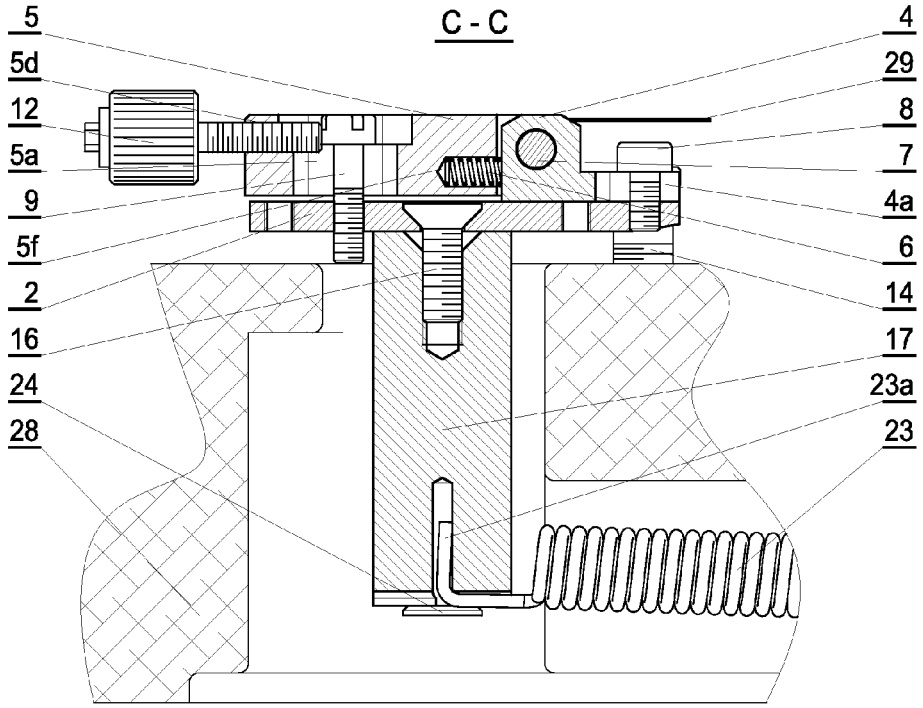
FIG. 9 is a partial sectional view taken along line C-C of FIG. 6.
Figure 10:
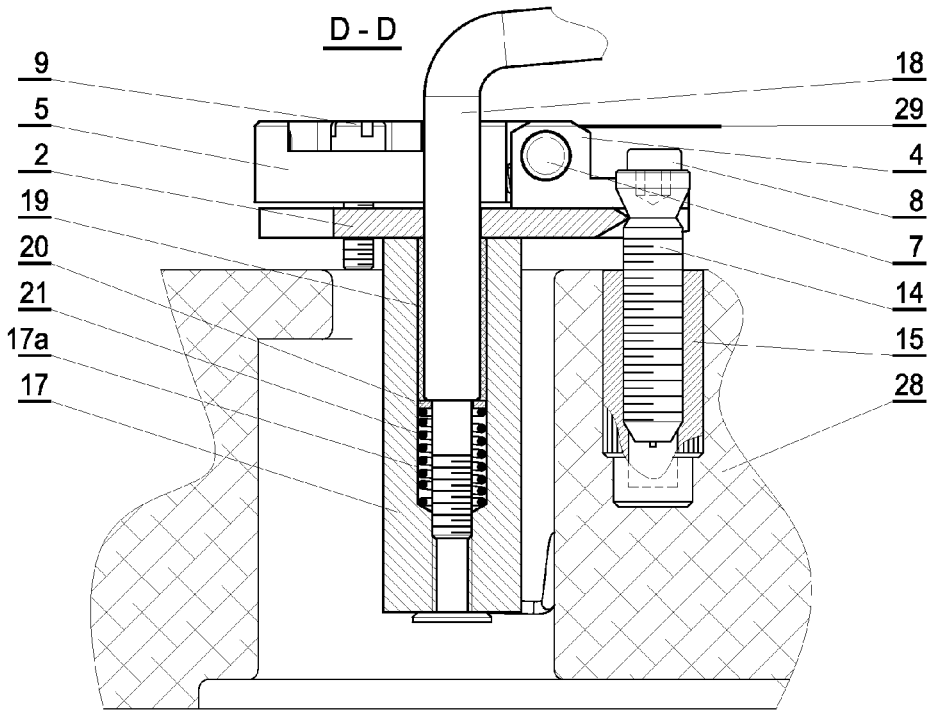
FIG. 10 is a partial sectional view taken along line D-D of FIG. 1.

A tremolo device 1 for a stringed musical instrument (FIG. 1 and FIG. 2) according to the present invention comprises a base plate 2, on the upper surface of which are independently mounted saddle assemblies 3, corresponding to the number of the strings 29. Each assembly 3 (FIG. 5 and FIG. 6) including a front 4 and a rear 5 string saddle with asymmetrically projecting arms movably connected to each other via a saddle assembly shaft 7 located perpendicularly to the corresponding string 29. To each saddle assembly 3 means are provided for their fixing on the base plate 2, for fine tuning, intonation adjustment and string locking. In the front 4 string saddle (FIG. 7) a slot 4*a* is formed housing a saddle mounting screw 9 mounted in a threaded opening in the base plate 2. In the back portion of the rear 5 string saddle (FIG. 7) a rear slot 5*a* is formed housing a fine tuning screw mounted in a threaded opening in the base plate 2. In the screw 9 head (FIG. 3) crossed slots 9*a* are formed, allowing fine tuning of the string 29 by guitar pick 33 or nail. In the front portion of the rear saddle 5 (FIG. 6) a string receiving recess 5*b* is formed extending to the front slot 5*c*, which axis is parallel to the axis of slot 4*a* in the front 4 string saddle and to the axis of the rear slot 5*a*. In the front slot 5*c* a string lock insert 10 is mounted. From the front slot 5*c* (FIG. 8) to the back wall of the rear string saddle 5 a lower threaded opening 5*e* is extended, in which a string lock screw 11 is mounted and screwed up to the front slot 5*c* and to the string lock insert 10 mounted in it. From the rear slot 5*a* (FIG. 9) to the back wall of the rear string saddle 5 an upper threaded opening 5*d* is formed, in which an adjustment screw 12 is disposed, contacting with the fine tuning screw 9 head. The axes of the slot 4*a* in the front string saddle 4 (FIG. 6) and the rear slot 5*a* in the rear string saddle 5 are parallel and displaced with respect to the axis of the corresponding string 29. The string lock insert 10 (FIG. 2) is formed by a cylindrical body. In the lower portion of the string lock insert 10 a slot 10*a* is formed (FIG. 8), reaching the rear part of the string lock screw 11. The string lock insert 10 mounted so that the slot 10*a* is at the height of the string lock screw 11. The base plate 2 (FIG. 3 and FIG. 10) abuts against a pivot assembly 13, each one including a pivot stud 14 and a pivot insert 15. In the base plate 2 front end circular recesses are provided, conically beveled at the upper and lower surface of the base plate 2, so that with each circular slot a knife edge is formed engaged with a double conical recess below the head of each pivot stud 14. To the lower surface of the base plate 2 (FIG. 4 and FIG. 9) a sustain block 17 is mounted by means of block mounting screws 16. In one side of the sustain block 17 (FIG. 2) a two step opening 17*a* with an arm bush 19 is formed, through which a tremolo arm 18 passes with thread in its lower end, corresponding to that of the lower end of the opening 17*a*. Under the arm bush 19 (FIG. 10), an arm washer 20 and an arm spring 21 are consecutively disposed. In the base plate 2 (FIG. 4) a second opening for the tremolo arm 18 is formed symmetrically to the mid distance between the pivot assemblies 13. To the lower side of the sustain block 17 a balancing mechanism 22 is mounted, inserted in a cavity provided on the lower side of the instrument body, including a number of springs which ends are fixed to the spring claw 25, the other ends are immovably fixed to the sustain block 17 by means of hooks 23*a* and spring fix screws 24. The adjustment screw 12 (FIG. 9) is mounted in the upper threaded opening 5*d* of the rear string saddle 5. The rear string saddle 5 reaching the fine tuning spring 6, which axis is perpendicular to the axis of the saddle assembly shaft 7 and the axes are at some distance from each other. In the front portion of the rear string saddle 5 an opening 5*f* is formed, which axis is nonparallel to and does not intersect the saddle assembly shaft 7 axis and also the string 29 axis. In the opening 5*f* the fine tuning spring 6 is disposed reaching the opening bottom with one end and with the other—the back wall of the front string saddle 4.

Operation of the Invention

The tremolo device 1 (FIG. 1 and FIG. 10) is movably mounted in a preliminary prepared cavity in the body 28 of the instrument 27 via a pair of pivot studs 14 and pivot inserts 15 fixed in the body 28 and balances by being pulled in one direction by the tensile force in the strings 29, and in the other direction—by the force of springs 23 of the balancing mechanism 22. Controlled by spring claw screws 26, regulating the tension in springs 23, these two forces are balanced so that the tremolo surface is parallel to the plane of the body 28 of the instrument. The strings 29 are tightly fixed in the top lock device 32 or in the machine heads 30, as well as in the tremolo device 1.

When the arm 18 is pressed to the body 28 of the instrument, the tremolo device 1 gets rotated around the pivot points axis in one direction so that the tensile force in the strings 29 decreases, causing lowering of strings 29 tone pitch.

When the arm 18 is pulled in the opposite direction—the tensile force in the strings 29 gets increased, causing increase of strings 29 tone pitch.

Figure 11:
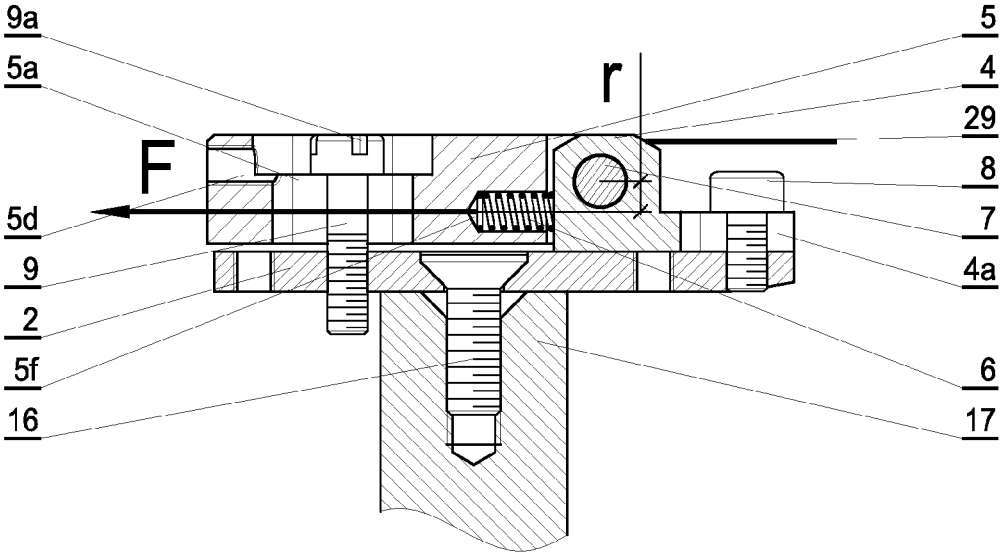
FIG. 11 is a side sectional view taken along line C-C of FIG. 6 with illustration of the fine tuning spring force F and the perpendicular distance r from the rotation axis.

The designation of the fine tuning spring 6 (FIG. 11) is to create a torque around the saddle assembly shaft 7 axis through the force F and the perpendicular distance r from the rotation axis, so that the rear string saddle 5 surface located under the fine tuning screw 9 head, should always touch the surface of the lower side of the fine tuning screw 9 head, even in the cases when the arm 18 is pressed and the strings 29 are completely loose.

The functions of the tremolo device according to the invention are as follows: locking one end of the strings 29 to the body 28 of the instrument; adjusting the strings 29 height; adjusting the strings 29 intonation; fine tuning of the strings 29; smooth decrease or increase of the played tone by using the arm 18.

The advantage of the tremolo device for a stringed musical instrument 1 according to the invention is its simplified construction, finding expression in simplification of the sustain block and the base plate by forming a fine tuning spring opening 5*f* in the front portion of the rear string saddles 5.

The easier usage of the device is achieved in the device assembly and maintenance due to the decreased number of parts and units. It is also expressed in dropping out of a number of free fine tuning springs.

The improved sustain is achieved by elimination of a number of openings and recesses in the sustain block and base plate. Thus the sustain block increases its mass, resulting in improved sustain.

CITED LITERATURE

1. WO2012/162764A1

The invention claimed is:

1. A tremolo device for a stringed musical instrument comprises a base plate, on the upper surface of which saddle assemblies are independently mounted corresponding to the number of the strings, each assembly including a front and a rear string saddle with asymmetrically projecting arms movably connected to each other via a saddle assembly shaft located perpendicularly to the corresponding string, where to each saddle assembly means are provided for their fixing on the base plate, for fine tuning, intonation adjustment and string locking, wherein in the front string saddle a slot is formed housing a saddle mounting screw mounted in a threaded opening in the base plate and in the back portion of the rear string saddle a rear slot is formed housing a fine tuning screw mounted in a threaded opening in the base plate, in the front portion of the rear saddle a string receiving recess is formed extending to a front slot, which axis is parallel to the axis of the slot in the front string saddle and to the axis of the rear slot, in which front slot a string lock insert is mounted, and from the front slot to the back wall of the rear string saddle a lower threaded opening is extended, in which a string lock screw is mounted and screwed up to the front slot and to the string lock insert mounted in it, and from the rear slot to the back wall of the rear string saddle an upper threaded opening is formed, in which an adjustment screw is disposed, contacting with the fine tuning screw head, wherein the axes of the slot in the front string saddle and the rear slot in the rear string saddle are parallel and displaced with respect to the axis of the corresponding string, the string lock insert is formed by a cylindrical body wherein in the lower portion of the string lock insert a slot is formed reaching the rear part of the string lock screw, the string lock insert is mounted so that the slot is at the height of the string lock screw and the base plate abuts against a pivot assembly, each one including a pivot stud and a pivot insert, and to the base plate front end circular recesses are provided, conically beveled at the upper and lower surface of the base plate so that with each circular slot a knife edge is formed engaged with a double conical recess below the head of each pivot stud, and to the lower surface of the base plate a sustain block is mounted by means of block mounting screws, wherein in one side of the sustain block a two step opening with an arm bush is formed, through which a tremolo arm passes, to the lower side of the sustain block a balancing mechanism is mounted, including a number of springs which ends are fixed to a spring claw, the other ends are immovably fixed to the sustain block by means of hooks and spring fix screws, the rear string saddle reaching a fine tuning spring, which axis is perpendicular to the axis of the saddle assembly shaft, the axes being at some distance from each other, wherein in the front portion of the rear string saddle (5) an opening (5*f*) is formed, which axis is nonparallel to and does not intersect the saddle assembly shaft (7) axis and also does not intersect the string (29) axis, in the opening (5*f*) the fine tuning spring (6) is disposed reaching the opening bottom with one end and with the other—the back wall of the front string saddle (4).

* * * * *